US007889870B2

(12) United States Patent
Chun

(10) Patent No.: US 7,889,870 B2
(45) Date of Patent: Feb. 15, 2011

(54) METHOD AND APPARATUS TO SIMULATE 2-CHANNEL VIRTUALIZED SOUND FOR MULTI-CHANNEL SOUND

(75) Inventor: Ingyu Chun, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1160 days.

(21) Appl. No.: 11/549,357

(22) Filed: Oct. 13, 2006

(65) Prior Publication Data

US 2007/0160217 A1 Jul. 12, 2007

(30) Foreign Application Priority Data

Jan. 10, 2006 (KR) ..... 10-2006-0002716

(51) Int. Cl.
*H04R 5/00* (2006.01)
*H04R 5/02* (2006.01)

(52) U.S. Cl. ..... 381/1; 381/309

(58) Field of Classification Search ..... 381/309, 381/310, 61, 63, 74, 1
See application file for complete search history.

(56) References Cited

U.S. PATENT DOCUMENTS 7,149,314 B2 * 12/2006 Dahl et al. ..... 381/63

FOREIGN PATENT DOCUMENTS

| | | |
|---|---|---|
| CN | 1494812 | 5/2004 |
| CN | 1533633 | 9/2004 |
| KR | 10-161901 | 8/1998 |
| KR | 2004-31814 | 4/2004 |
| WO | 99/49574 | 9/1999 |

OTHER PUBLICATIONS

Chinese Office Action dated Apr. 13, 2009 issued in CN 2006101725719.

* cited by examiner

*Primary Examiner*—Ping Lee
(74) *Attorney, Agent, or Firm*—Stanzione & Kim LLP

(57) ABSTRACT

A stereo sound generation method and apparatus to generate a stereo sound, by using 2-channel headphones, earphones, or speakers, from a multi-channel sound signal reproduced through a variety of media such as a DVD-video, and a DVD-audio. The stereo sound generation method of generating a 2-channel stereo sound from a 5.1-channel sound signal includes: generating a first channel stereo signal and a second channel stereo signal, by applying the difference between times taken to arrive at two ears of a listener, respectively, and a difference between sound pressures of the two ears that are different or constant in frequency to each of a first channel signal and a second channel signal being input; generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input; generating a first channel signal and a second channel signal from each of a fifth channel signal and a sixth channel signal being input; generating a plurality of reflected sounds, by applying delay values and gain values different from each other to first through fifth channel signals being input, and from the plurality of generated reflected sounds, generating a first channel signal and a second channel signal; and adding the generated first channel signals and adding the generated second channel signals.

16 Claims, 11 Drawing Sheets

METHOD AND APPARATUS TO SIMULATE 2-CHANNEL VIRTUALIZED SOUND FOR MULTI-CHANNEL SOUND

CROSS-REFERENCE TO RELATED APPLICATIONS

This application claims the benefit of Korean Patent Application No. 10-2006-0002716, filed on Jan. 10, 2006, in the Korean Intellectual Property Office, the disclosure of which is incorporated herein in its entirety by reference.

BACKGROUND OF THE INVENTION

1. Field of the Invention

The present general inventive concept relates to a stereo sound generation apparatus, and more particularly, to a stereo sound generation method and apparatus to generate a stereo sound, by using 2-channel headphones, earphones, or speakers, from a multi-channel sound signal reproduced through a variety of media such as a DVD-video, and a DVD-audio.

2. Description of the Related Art

Recently, a technology allowing a user to listen to 3D stereo sound with only headphones without speakers supporting 5.1 channels has been and is being implemented.

A home theater system outputs sounds through 5 speakers. However, these sounds do not always arrive directly at the ears of a listener, but part of these sounds is reflected by walls or furniture in a room and then arrives at the listeners ears. When all sound signals arrive at the listeners ears, the brain receives all these sound signals and senses the sound signals as a stereo sound.

In order to implement this stereo sound only with ordinary headphones, a stereo sound generation system based on a processor coding audio information has been and is being developed.

A technology related to this stereo sound generation system is disclosed in WO 99/49574 (PCT/AU99/00002, filed 6 Jan. 1999, entitled, "AUDIO SIGNAL PROCESSING METHOD AND APPARATUS").

In the technology related to the conventional stereo sound generation system, a multi-channel audio signal is down-mixed into a 2-channel audio signal by using a head related transfer function (HRTF).

Referring to FIG. 1, a 5.1-channel audio signal is input. The 5.1 channels include a left front channel 2, a right front channel, a center front channel, a left surround channel, a right surround channel, and a low frequency effect (LFE) channel. In each channel, an impulse response function relative to the left ear and right ear of a listener is applied. Accordingly, in relation to the left front channel 2, the impulse response function 4 of the left ear corresponding to the left front channel signal is convoluted with a left front channel signal 3. The impulse response function 4 of the left ear relative to the left front channel signal 3 uses a HRTF as an impulse response to be received by the left ear as an ideal spike output from a left front channel speaker placed at an ideal position. An output signal 7 is added to a left channel signal 10. Similarly, in order to generate an output signal 9 to be added to a right channel signal 11, an impulse response function 5 of the right ear relative to the left front channel signal 3 is convoluted with the left front channel signal 3. Accordingly, the arrangement of FIG. 1 requires approximately 12 convolution operations in relation to the 5.1 channel signals. As a result, by down-mixing the 5.1 channel signals to a 2-channel signal by combining the measured HRTFs, the same surround effect as when a multi-channel signal is reproduced can be achieved.

However, though the system of FIG. 1 provides a stereo effect by localizing a plurality of virtual sound sources, it does not generate reflected sounds to create a spatial effect that can be felt by the listener.

SUMMARY OF THE INVENTION

The present general inventive concept provides a stereo sound generation method and apparatus by localizing a plurality of virtual sound sources so that a stereo effect is provided and by generating reflected sounds so that a spatial effect can be generated.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a stereo sound generation method of generating a 2-channel stereo sound from a 5.1-channel sound signal, the method including: generating a first channel stereo signal and a second channel stereo signal, by applying the difference between times taken to arrive at the two ears, respectively, and the difference between the sound pressures of the two ears that are different or constant in frequency, to each of a first channel signal and a second channel signal being input; generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input; generating a first channel signal and a second channel signal from each of a fifth channel signal and a sixth channel signal being input; generating a plurality of reflected sounds, by applying delay values and gain values different to each other to first through fifth channel signals being input, and from the plurality of generated reflected sounds, generating a first channel signal and a second channel signal; and adding the generated first channel signals and adding the generated second channel signals.

The foregoing and/or other aspects and utilities of the present general inventive concept are also achieved by providing a stereo sound generation apparatus of generating a 2-channel stereo sound from multi-channel sound signals, the apparatus including: a multiplication unit multiplying the multi-channel sound signals by gain values different to each other, respectively; a plurality of delay filter unit generating reflected sounds by applying delay values different to each other to the channel signals, respectively, multiplied in the multiplication unit; an addition unit adding the reflected sounds of respective channels generated in the delay filter units; and an all-pass filter unit comprising a plurality of all-pass filters that have delay coefficients different from each other and gain values different from each other and are connected in series, and generating a plurality of reflected sounds from the reflected sounds added in the addition unit.

The foregoing and/or other aspects and utilities of the present general inventive concept are also achieved by providing a stereo sound generation method of generating a 2-channel stereo sound from multi-channel sound signals, the method including generating reflected sounds from respective ones of the input sound signals, adding each of the generated reflected sounds, and generating reflected sounds from the reflected sounds added in the adding unit.

The foregoing and/or other aspects and utilities of the present general inventive concept are achieved by providing a stereo sound generation apparatus to generate a 2-channel stereo sound from multi-channel sound signals, the apparatus including multipliers to multiply corresponding channel signals of the multi-channel sound signals by predetermined gain values for each channel signal, delay filters each to apply a predetermined delay value to the channel signal multiplied by a corresponding one of the multipliers, an addition unit to add the multiplied and delayed signals, and at least two all-pass filters having delay coefficients different from each other and gain values different from each other and are connected in series to generate a plurality of reflected sounds from the sounds added in the addition unit.

The multipliers can include a first multiplier to multiply a left front channel signal by a first gain, a second multiplier to multiply a right front channel signal by a second gain, a third multiplier to multiply a center front channel signal by a third gain, a fourth multiplier to multiply a left surround channel signal by a fourth gain, and a fifth multiplier to multiply a right surround channel signal by a fifth gain.

The multipliers can include a first multiplier to multiply a left front channel signal by a first gain, a second multiplier to multiply a right front channel signal by a second gain, a third multiplier to multiply a left surround channel signal by a third gain, a fourth multiplier to multiply a right surround channel signal by a fourth gain, a fifth multiplier to multiply a center front channel signal by a fifth gain, and a sixth multiplier to multiply a center rear channel signal by a sixth gain.

The multipliers can include a first multiplier to multiply a left front channel signal by a first gain, a second multiplier to multiply a right front channel signal by a second gain, a third multiplier to multiply a left surround channel signal by a third gain, a fourth multiplier to multiply a right surround channel signal by a fourth gain, a fifth multiplier to multiply a left rear channel signal by a fifth gain, a sixth multiplier to multiply a right rear channel signal by a sixth gain, and a seventh multiplier to multiply a center front channel signal by a fifth gain.

The foregoing and/or other aspects and utilities of the present general inventive concept are achieved by providing a stereo sound generation apparatus to generate a 2-channel stereo sound from multi-channel sound signals, the apparatus including a plurality of reflected sound generators to generate corresponding reflected sounds from respective ones of the input sound signals, an adding unit to add each of the generated reflected sounds, and at least two all-pass filters connected in series to generate reflected sounds from the reflected sounds added in the adding unit.

The foregoing and/or other aspects and utilities of the present general inventive concept are achieved by providing a recording medium containing a method of generating a 2-channel stereo sound from a 5.1-channel sound signal, the method including generating a first channel stereo signal and a second channel stereo signal, by applying the difference between times taken to arrive at the two ears, respectively, and the difference between the sound pressures of the two ears that are different or constant in frequency, to each of a first channel signal and a second channel signal being input, generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input, generating a first channel signal and a second channel signal from each of a fifth channel signal and a sixth channel signal being input, generating a plurality of reflected sounds, by applying delay values and gain values different to each other to first through fifth channel signals being input, and from the plurality of generated reflected sounds, generating a first channel signal and a second channel signal, and adding the generated first channel signals and adding the generated second channel signals.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
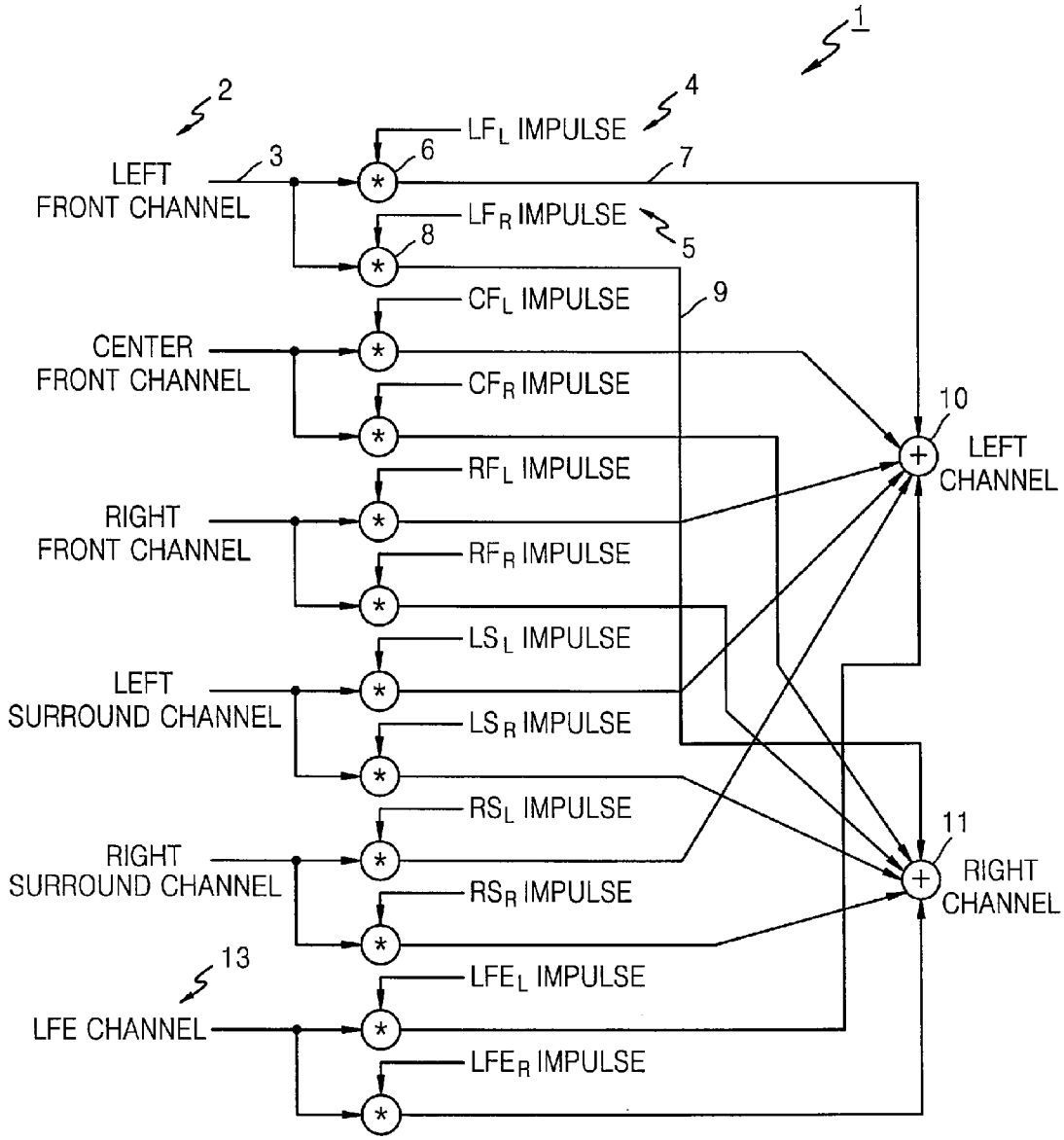
FIG. 1 (PRIOR ART)
FIG. 1 is a block diagram of a conventional stereo sound generation apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
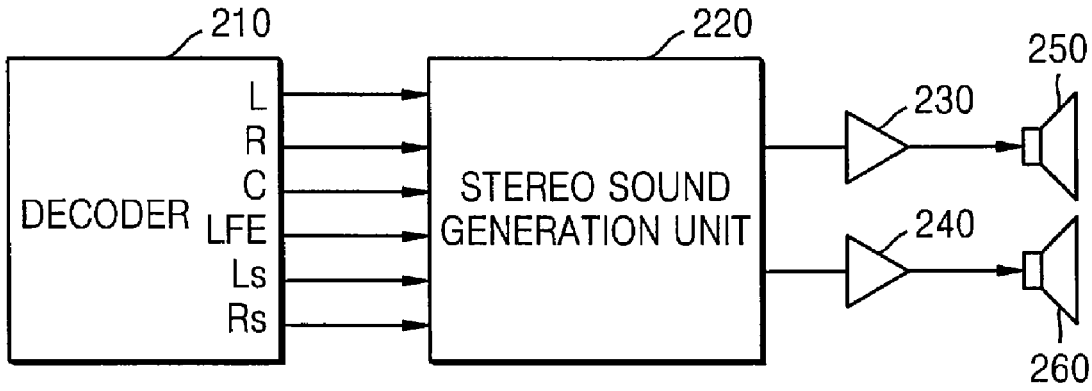
FIG. 2 is a block diagram illustrating an audio reproducing system to which a stereo sound generation apparatus according to an embodiment of the present general inventive concept is applied.

FIG. 2 is a block diagram illustrating an audio reproducing system to which a stereo sound generation apparatus according to an embodiment of the present general inventive concept is applied.

The audio reproducing apparatus of FIG. 2 includes a decoder 210, a stereo sound generation unit 220, left and right channel amplifier units 230 and 240, and left and right channel speakers 250 and 260.

The decoder 210 decodes an audio bitstream input from an audio generation apparatus, such as a DVD reproducing apparatus, into 5.1 channels, i.e., a left channel, a right channel, a center channel, a left surround channel, a right surround channel, and a lower frequency effect (LFE) channel. In another embodiment, the decoder 210 may decode an audio bitstream into multiple channels other than 5.1 channels, such as 6.1 channels and 7.1 channels.

The stereo sound generation unit 220 performs digital signal processing to generate the decoded multi-channel signal into stereo sounds and reflected sounds so as to generate a stereo effect and a spatial effect.

The left and right channel amplifier units 230 and 240 amplify the left and right channel audio signals generated in the stereo sound generation unit 220 and output the amplified signals to the left and right channel speakers 250 and 260, respectively. At this time, the left and right channel speakers 250 and 260 may be replaced by 2-channel headphones or earphones.

Figure 3:
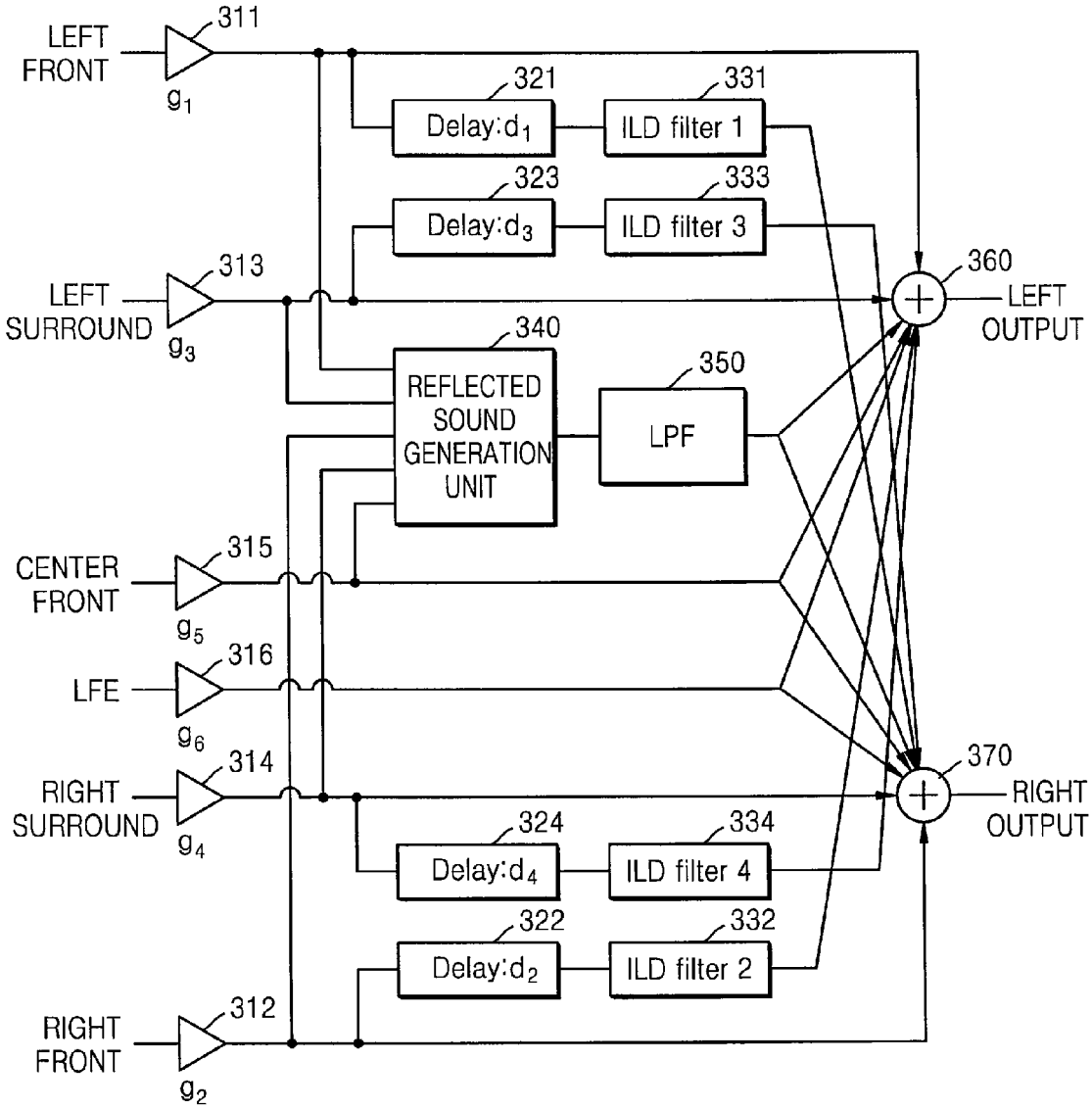
FIG. 3 illustrates a stereo sound generation unit of FIG. 2 for 5.1 channels according to an embodiment of the present general inventive concept.

FIG. 3 illustrates the stereo sound generation unit 220 of FIG. 2 for 5.1 channels according to an embodiment of the present general inventive concept.

Referring to FIG. 3, left channel, right channel, center channel, left surround channel, right surround channel, and LFE channel signals are input. First through sixth multipliers 311 through 316 multiply the input signals (LF, RF, Ls, Rs, CF, LFE) by gain values (g1, g2, g3, g4, g5, g6) different from each other, respectively. At this time, the gain values are identically applied to related left and right signals as a positive value equal to or less than 1 in order to secure headroom.

Figure 4:
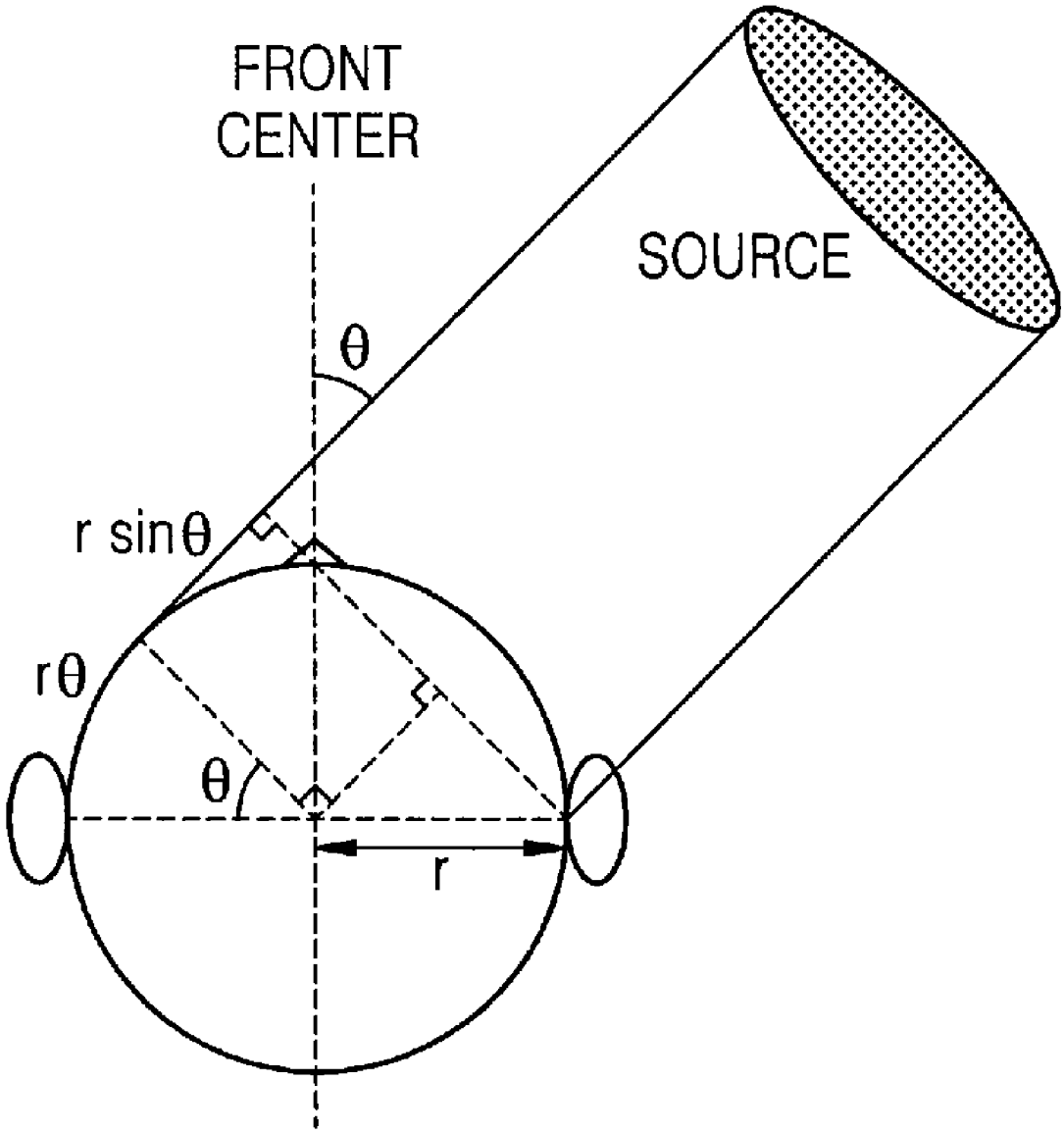
FIG. 4 is a conceptual diagram illustrating the difference between times taken in two ears applied to the stereo sound generation unit of FIG. 3 according to an embodiment of the present general inventive concept.

The direction of a sound source relative to a listener can be perceived from the difference between sound pressures incident on the two ears of a listener. A representative method of perceiving the direction of a sound source is a method of using an interaural time difference (ITD) and an interaural level difference (ILD). The ITD indicates the time difference of signals transferred to the two ears of a listener caused by the length difference of the paths from a sound source to the two ears as illustrated in FIG. 4. The ITD can be expressed as the following equation 1:

$$ITD=r(\theta+\sin\theta)/C_0 \quad (1)$$

where $C_0$ denotes the velocity of sound which is about 344 m/s in air.

The ITD can be effectively perceived in a low frequency band equal to or less than about 700 Hz.

Meanwhile, the ILD indicates the amplitude difference or level difference of signals transferred to the ears of a listener. The ILD is caused by diffusion of sound occurring mainly in the head and ears.

Generally, when a sound signal is listened to with 2-channel headphones or earphones, the sound image is formed inside the head or two ears in many cases. If the sound image is moved so that the sound image is felt as if the sound comes from two speakers, then the listener can experience a stereo effect. Accordingly, the ITD and the ILD move the sound image with respect to the left front channel, the right front channel, the left surround channel, and the right surround channel.

The left front channel signal passing through the first multiplier 311 arrives at the left ear of a left sound image. This left front channel signal arrives at the right ear of the left sound image through a first delay filter 321 having a delay value (d1) and a first ILD filter 331. Also, the right front channel signal passing through the second multiplier 312 arrives at the right ear of a right sound image. This right front channel signal arrives at the left ear of the right sound image through a second delay filter 322 having a delay value (d2) and a second ILD filter 332.

Also, the left surround channel signal passing through the third multiplier 313 arrives at the left ear of a left rear sound image. This left surround channel signal arrives at the right ear of the left rear sound image through a third delay filter 323 having a delay value (d3) and a third ILD filter 333.

Also, the right surround channel signal passing through the fourth multiplier 314 arrives at the right ear of a right rear sound image. This right surround channel signal arrives at the left ear of the right rear sound image through a fourth delay filter 324 having a delay value (d4) and a fourth ILD filter 334.

In this case, the delay values (d1, d2, d3, d4) of the first through fourth delay filters 321 through 324 are used to perform respective ITD operations, and the first through fourth ILD filters 331 through 334 perform ILD operations. Here, in order to perform ILD operations, filters to which an HRTF considering the difference between frequency components is applied, or low pass filters may be used, or multiplication by gain values without considering the difference between frequency components may replace the ILD operations.

In order to maintain the sound qualities of the left and right channel signals to the best possible qualities, a signal for an ear of a listener closer to any one of the left and right channel sound images is output without change, while a signal for the other ear is output after a time delay of an ITD quantity and a level reduction of an ILD quantity are applied to the signal. By doing so, a stereo effect can be provided with a less amount of computation.

The signals of the left front channel and the left surround channel that arrive at the left ear of a listener and the signals passing through the second and fourth ILD filters 332 and 334 are added in a first adder 360. Likewise, the signals of the right front channel and the right surround channel that arrive at the right ear of the listener and the signals passing through the first and third ILD filters 331 and 333 are added in a second adder 370.

Also, each of the center front channel signal passing through the fifth multiplier 315 and the LFE channel signal passing through the sixth multiplier 316 is added to the first and second adders 360 and 370. Here, it is assumed that the sound sources of the center front channel signal and the LFE channel signal are positioned at the center, and there is neither a time difference nor a level difference between the two ears.

Also, in order to avoid in-head localization of a sound image that is liable to occur when headphones or earphones are used to listen to a reproduced sound, and to make the listener feel as if a sound image is localized outside the head, a virtual room is designed so that a plurality of reflected sounds are reproduced.

A reflected sound generation unit 340 generates a plurality of reflected sounds from the left front channel, right front channel, center front channel, left surround channel, and right surround channel signals in order to provide a spatial effect to a listener. That is, the reflected sound generation unit 340 provides an effect of localizing the sound image of each channel outside the head of the listener.

A low pass filter (LPF) 350 implements an effect of absorbing a high-pitched sound in a virtual room by low-pass filtering the reflected sounds generated in the reflected sound generation unit 340. Accordingly, the signal output from the LPF unit 350 is added to the first adder 360 and the second adder 370. The reflected sound generation unit 340 will be explained later with reference to FIGS. 7 through 11.

Finally, the signal output from the first adder 360 and the signal output from the second adder 370 are output to 2-channel headphones or earphones through amplifiers. Also, the signals output from the first adder 360 and the second 370 can be output to 2-channel speakers by appropriately adjusting gain values.

Figure 5:
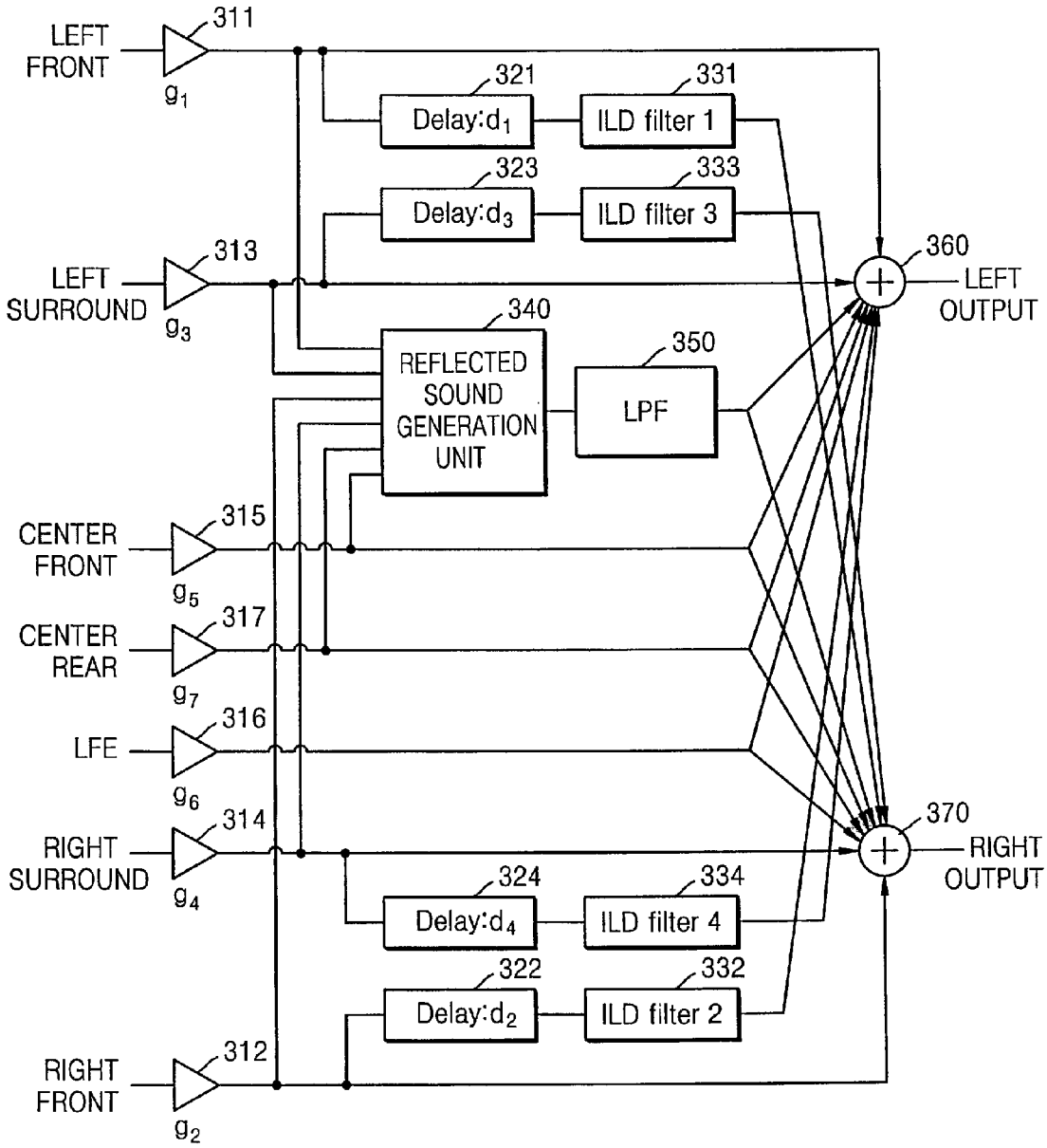
FIG. 5 illustrates the stereo sound generation unit of FIG. 2 for 6.1 channels according to an embodiment of the present general inventive concept.

FIG. 5 illustrates the stereo sound generation unit 220 of FIG. 2 for 6.1 channels according to an embodiment of the present general inventive concept.

Referring to FIG. 5, left front channel, right front channel, center front channel, center rear channel, left surround channel, right surround channel, and LFE channel signals are input. That is, compared to the 5.1-channel input signals, the center rear channel signal is additionally input. A seventh multiplier 317 multiplies the input center rear channel signal by a gain value (g7). At this time, this gain value (g7) is applied as a positive value equal to or greater than 1 in order to secure headroom. The center rear channel signal is added to the first adder 360 and the second adder 370 through the seventh multiplier 317. Here, it is assumed that the sound source of the center rear channel signal is positioned at the center, and there is neither a time difference nor a level difference between the two ears. Also, the center rear channel signal is added to the first adder 360 and the second adder 370 through the reflected sound generation unit 340 and the LPF unit 350.

Figure 6:
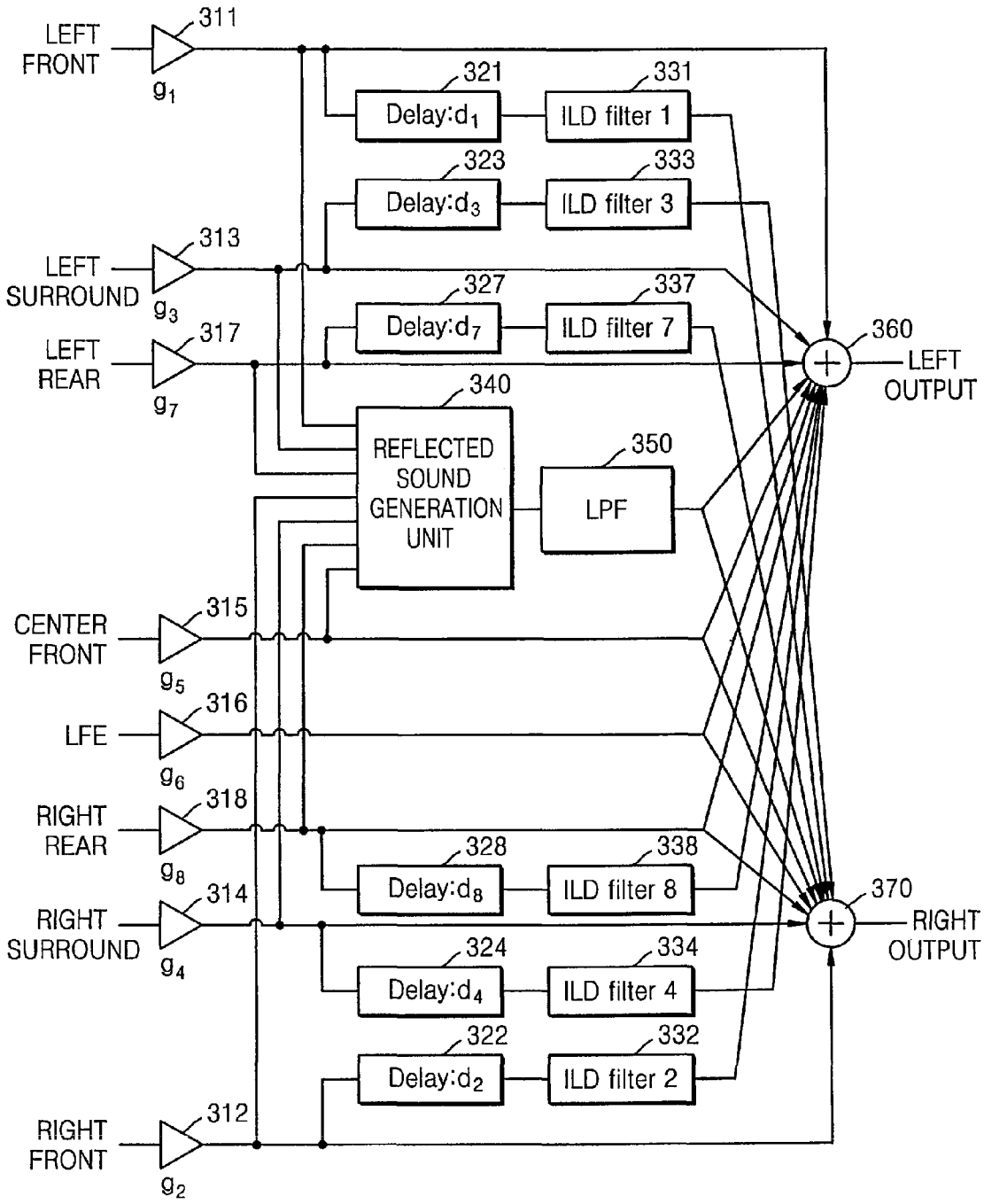
FIG. 6 illustrates the stereo sound generation unit of FIG. 2 for 7.1 channels according to an embodiment of the present general inventive concept.

FIG. 6 illustrates the stereo sound generation unit 220 of FIG. 2 for 7.1 channels according to an embodiment of the present general inventive concept.

Referring to FIG. 6, as compared to the 5.1-channel input signal, a left rear channel and right rear channel signals are added in the 7.1-channel input signal.

A seventh multiplier 317 and an eighth multiplier 318 multiply the left rear channel signal and the right rear channel signal by gain values g7 and g8 different from each other, respectively. Each of these gain values is set as a positive value equal to or less than 1 in order to secure headroom.

The left rear channel signal passing through the seventh multiplier 317 arrives at the left ear of a left rear sound image. This left rear channel signal arrives at the right ear of the left rear sound image through a seventh delay filter 327 having a delay value (d7) and a seventh ILD filter 337. Also, the right rear channel signal passing through the eighth multiplier 318 arrives at the right ear of a right rear sound image. This right rear channel signal arrives at the left ear of the right rear sound image through an eighth delay filter 328 having a delay value (d8) and an eighth ILD filter 338.

The left rear channel signal arriving at the left ear and the signal passing through the eighth ILD filter 338 are added in the first adder 360. Likewise, the right rear channel signal arriving at the right ear and the signal passing through the seventh ILD filter 337 are added in the second adder 370.

Also, each of the left rear channel signal and the right rear channel signal is added to the first adder 360 and the second adder 370 through the reflected sound generation unit 340 and the LPF unit 350.

Figure 7:
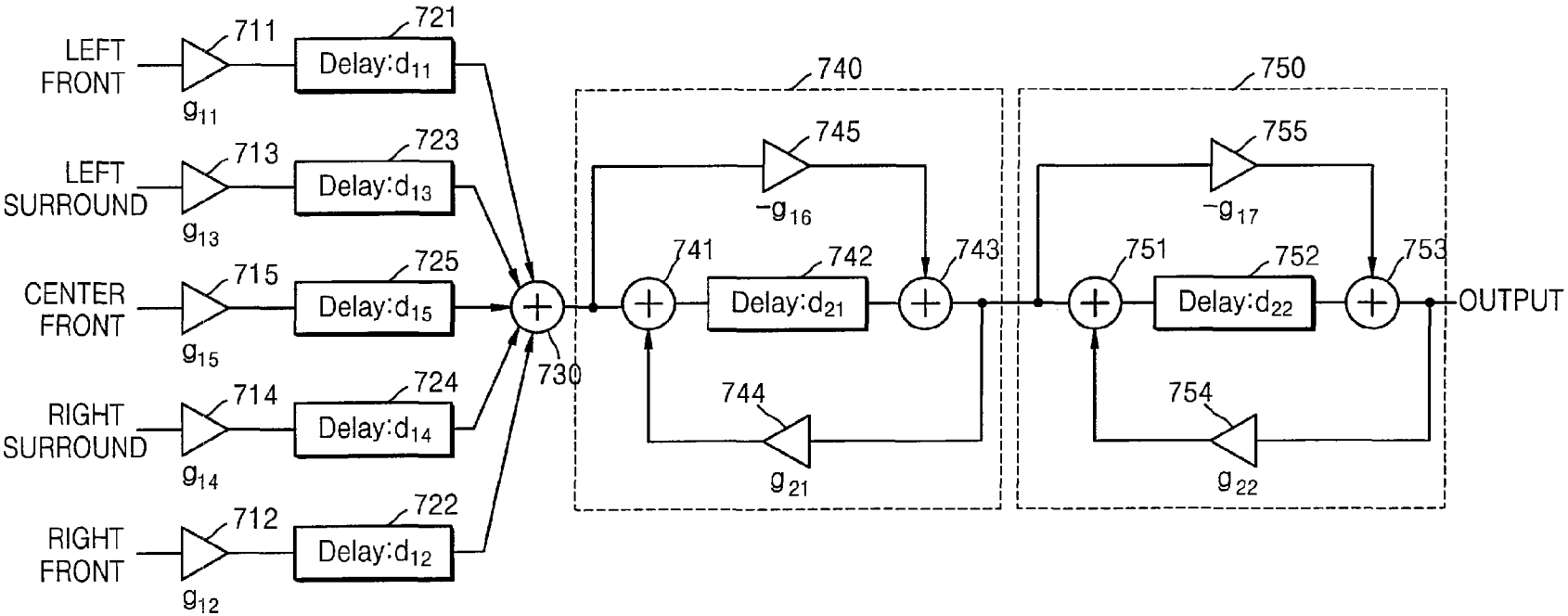
FIG. 7 illustrates a reflected sound generation unit of FIG. 2 for 5.1 channels according to an embodiment of the present general inventive concept.

FIG. 7 illustrates the reflected sound generation unit 340 of FIG. 3 for 5.1 channels according to an embodiment of the present general inventive concept.

In a 2-channel headphone reproduction system, an "in-head localization" phenomenon in which a stereo sound is not provided or not accurately reproduced and a sound image is localized inside the head of a listener, is liable to occur. Accordingly, by adding reflected sounds generated in a virtual space to the reproduced sound in the headphones, the in-head localization phenomenon can be removed and a sound image can be localized at a desired position outside the head.

The reflected sound can be implemented from a simple structural model of a room.

Figure 8:
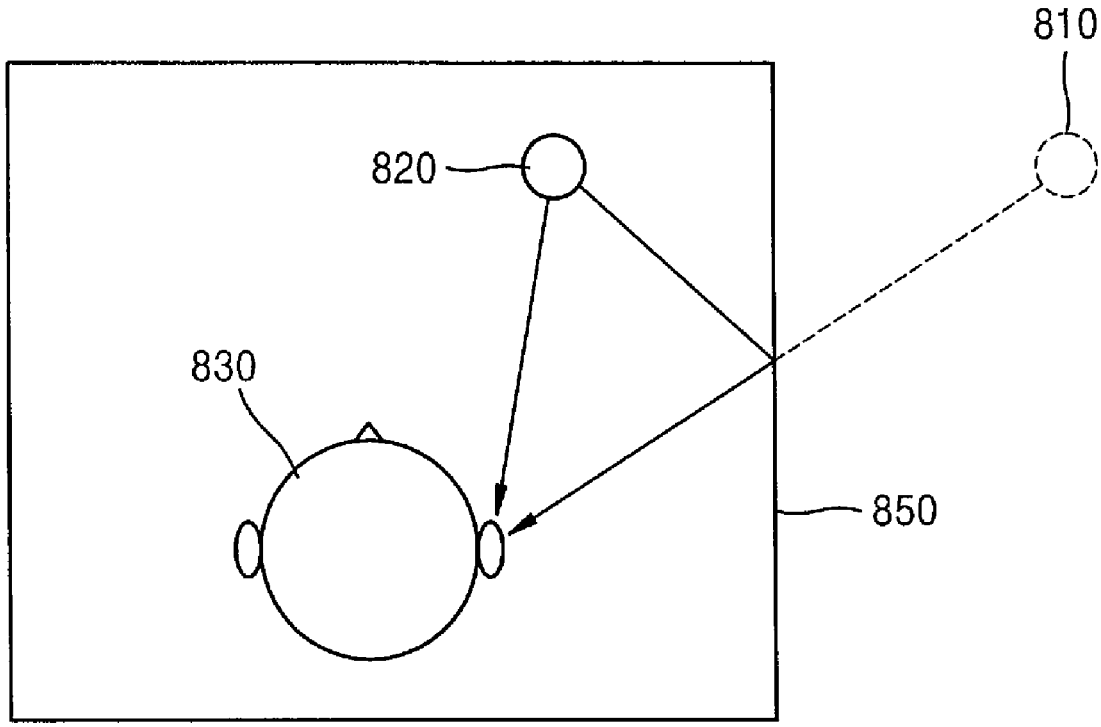
FIG. 8 is a conceptual diagram illustrating generation of a reflected sound in a virtual space applied to the reflected sound generation unit of FIG. 7 according to an embodiment of the present general inventive concept.

FIG. 8 illustrates one of plural mirror image sound sources in relation to one sound source 820 in a given virtual room 850. The mirror image sound source 810 is a virtual sound source generated by the reflection of the sound source 820 with the surface of a virtual wall as the axis of symmetry. The time it takes the reflected sound to travel from the sound source 820 to the ear of the listener 830 can be replaced by the time it takes to travel a straight line distance from the mirror image sound source 810 to the ear of the listener 830. Also, the strength of the reflected sound can be calculated from the strength of the mirror image sound source 810 depending on the degree of sound absorption of the wall surface. Virtual sound sources as well as the original sound source are generated again as an infinite number of sound sources by the sounds reflected by the wall surface of the virtual room. Among the infinite number of virtual sound sources, a finite number of sound sources are set at an appropriate level. Then, the delay time and strength of each virtual sound source are calculated. Each parameter to be calculated varies depending on the shape of a given room, a boundary condition, and the positions of the listener and the sound source. Accordingly, in order to generate effective reflected sounds, a virtual room should be designed appropriately.

The reflected sound generation unit is a filter which outputs one-channel stereo sound signal by applying a spatial effect with respect to a virtual space to a multi-channel input signal. In the reflected sound generation unit, the position of a virtual speaker of an input channel and the shape and condition of a virtual room may vary. If a virtual speaker is disposed in a virtual room having a given shape and boundary condition and a microphone is disposed at an optimized position, a reflected sound reflected from the virtual wall of the virtual room is also generated in addition to a direct sound directly transferred from the virtual speaker to the microphone. Reflected sounds have their respective delay times and sound pressures different from each other.

Referring again to FIG. 7, left front channel, right front channel, center front channel, left surround channel, and right surround channel signals are input. First through fifth multipliers 711 through 715 multiply the input signals (LF, RF, Ls, Rs, CF) by gain values (g11, g12, g13, g14 and g15) different from each other, respectively. First through fifth delay filters 721 through 725 apply delay values ($d_{11}$, $d_{12}$, $d_{13}$, $d_{14}$, $d_{15}$) different from each other, to the channel signals (LF, RF, Ls, Rs, CF), respectively, multiplied in the first through fifth multipliers 711 through 715.

Accordingly, the left front channel, right front channel, center front channel, left surround channel, and right surround channel signals are generated as reflected sounds in the respective channel through the multipliers 711 through 715 and the delay filters 721 through 725. At this time, the gain values (g11, g12, g13, g14, g15) are in proportion to relative sound pressure quantities of respective reflected sounds, and depend on the boundary condition of the virtual room. Also, the delay values ($d_{11}$, $d_{12}$, $d_{13}$, $d_{14}$, $d_{15}$) implement the time it takes a mirror image sound source generated from a virtual speaker corresponding to each channel positioned in a virtual room, to arrive at a listener, and depends on the size of the virtual space.

Figure 9A:
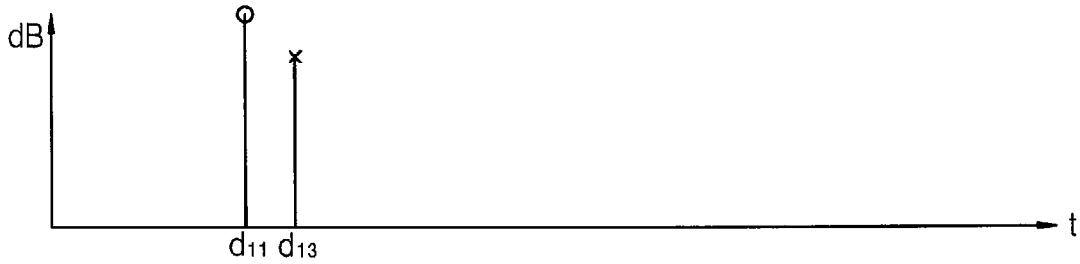
FIGS. 9A-9C are waveform diagrams illustrating the reflected sound generation unit of FIG. 7 according to an embodiment of the present general inventive concept.

An adder 730 adds signals of respective channels output from the first through fifth delay filters 721 through 725. For convenience of explanation, this will now be explained with a waveform diagram having only two signals, the left front channel and left surround channel signals. Referring to FIG. 9A, the left front channel signal having the gain value (g11)

and the delay value ($d_{11}$) and the reflected sound having the gain value (g13) and the delay value ($d_{13}$) are illustrated.

Figure 9B:
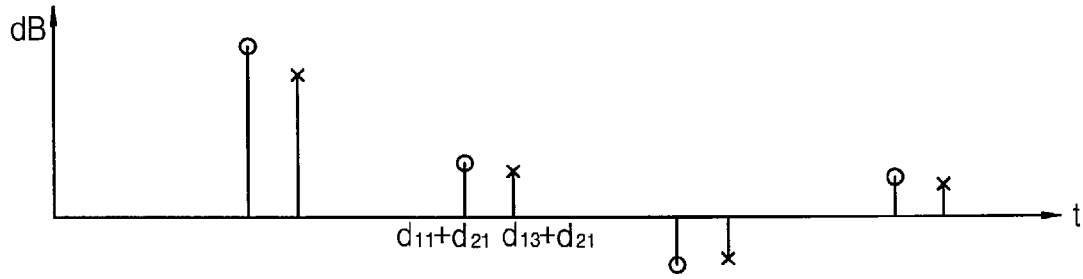
Figure 9C:
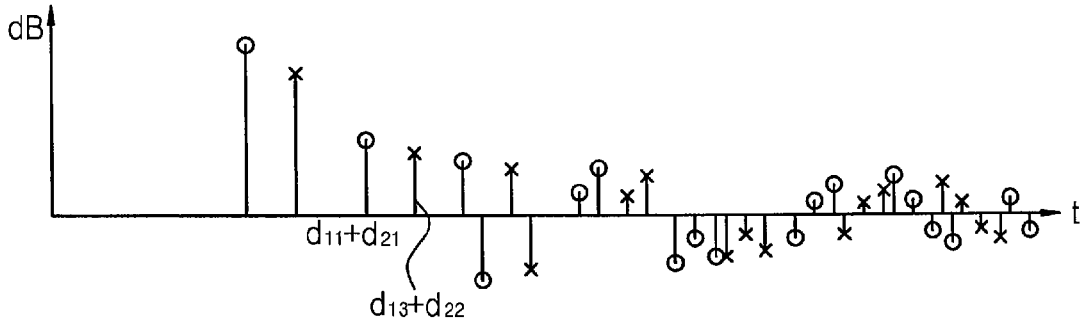

First and second all-pass filters 740 and 750 having different delay coefficients and gain values are connected to each other in series and generate a plurality of reflected sounds by all-pass filtering one reflected sound. That is, the all-pass filters 740 and 750 generate reflected sounds continuously through a feedback loop such that a spatial effect is provided. The waveform diagram of FIG. 9B illustrates reflected sounds generated from the first all-pass filters 740. The reflected sounds having a delay value ($d_{21}$) with respect to the reflected sound of FIG. 9A are continuously generated. Also, the waveform diagram of FIG. 9C illustrates reflected sounds generated from the second all-pass filters 750 and the reflected sounds having a delay value ($d_{22}$) with respect to the reflected sounds of FIG. 9B are continuously generated.

In the first and second all-pass filters 740 and 750, first and second adders 741 and 743, and 751 and 753, respectively, are connected to the input or output ends of delay units 742 and 752, respectively. Input signals to the all-pass filters 740 and 750, respectively, are fed forward to the second adders 743 and 753, respectively, through multipliers 745 and 755 having gain values ($-g_{16}$, $-g_{17}$), respectively, and the added outputs of the second adders 743 and 753 are fed back to the first adders 741 and 751 through multipliers 744 and 754 having gain values ($g_{21}$, $g_{22}$), respectively. The gain values of the two multipliers 745 and 744 have identical absolute values with opposite signs. As another embodiment, two or more all-pass filters may be disposed when necessary.

The all-pass filters 740 and 750 have respective delay values ($d_{21}$, $d_{22}$) and gain values ($g_{21}$, $g_{22}$). The delay values ($d_{21}$, $d_{22}$) rely on the size of a virtual space and the gain values ($g_{21}$, $g_{22}$) whose absolute values are less than 1 rely on the boundary condition of the virtual room. That is, delay values ($d_{21}$, $d_{22}$) and gain values ($g_{21}$, $g_{22}$) are extracted appropriately from a reflection pattern in the virtual room generated by virtual speakers corresponding to respective channels. Accordingly, if a virtual space having a suitable shape and boundary condition in order to provide an appropriate spatial effect is designed and virtual speakers and microphones are disposed at appropriate positions, respective delay values and gain values can be determined.

Figure 10:
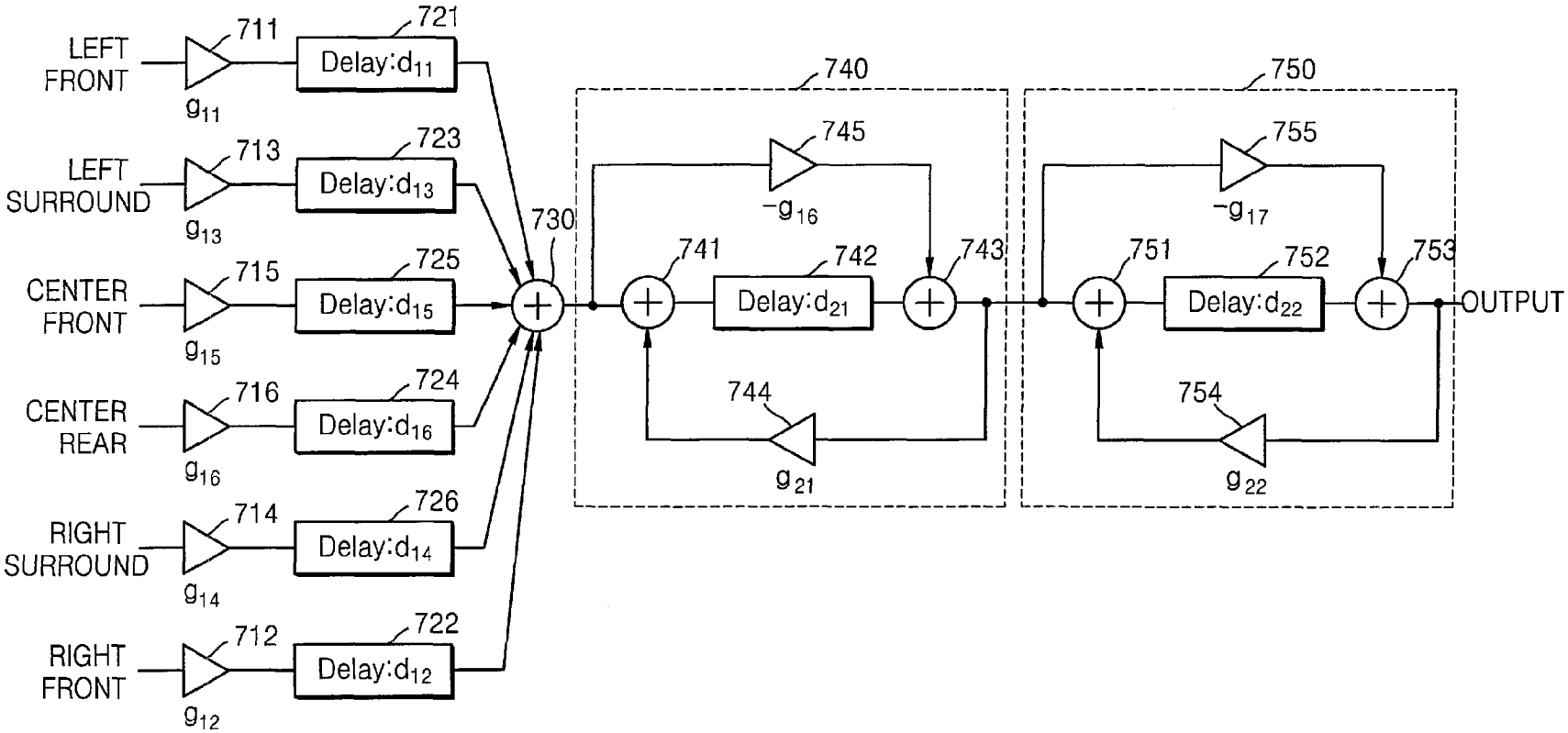
FIG. 10 illustrates the reflected sound generation unit of FIG. 2 for 6.1 channels according to an embodiment of the present general inventive concept.

FIG. 10 illustrates the reflected sound generation unit 340 of FIG. 3 for 6.1 channels according to an embodiment of the present general inventive concept. Referring to FIG. 10, compared to the 5.1-channel input signal, the 6.1-channel input signal further has a center rear channel. A center rear channel signal is generated as a reflected sound passing through a sixth multiplier 716 having a gain value (g16) and a sixth delay filter 724 having a delay value ($d_{16}$). The signal passing through the sixth multiplier 716 and the sixth delay filter 724 is added to other channel signals in the adder 730 and is generated as a plurality of reflected sounds through two all-pass filters 740 and 750 connected in series.

Figure 11:
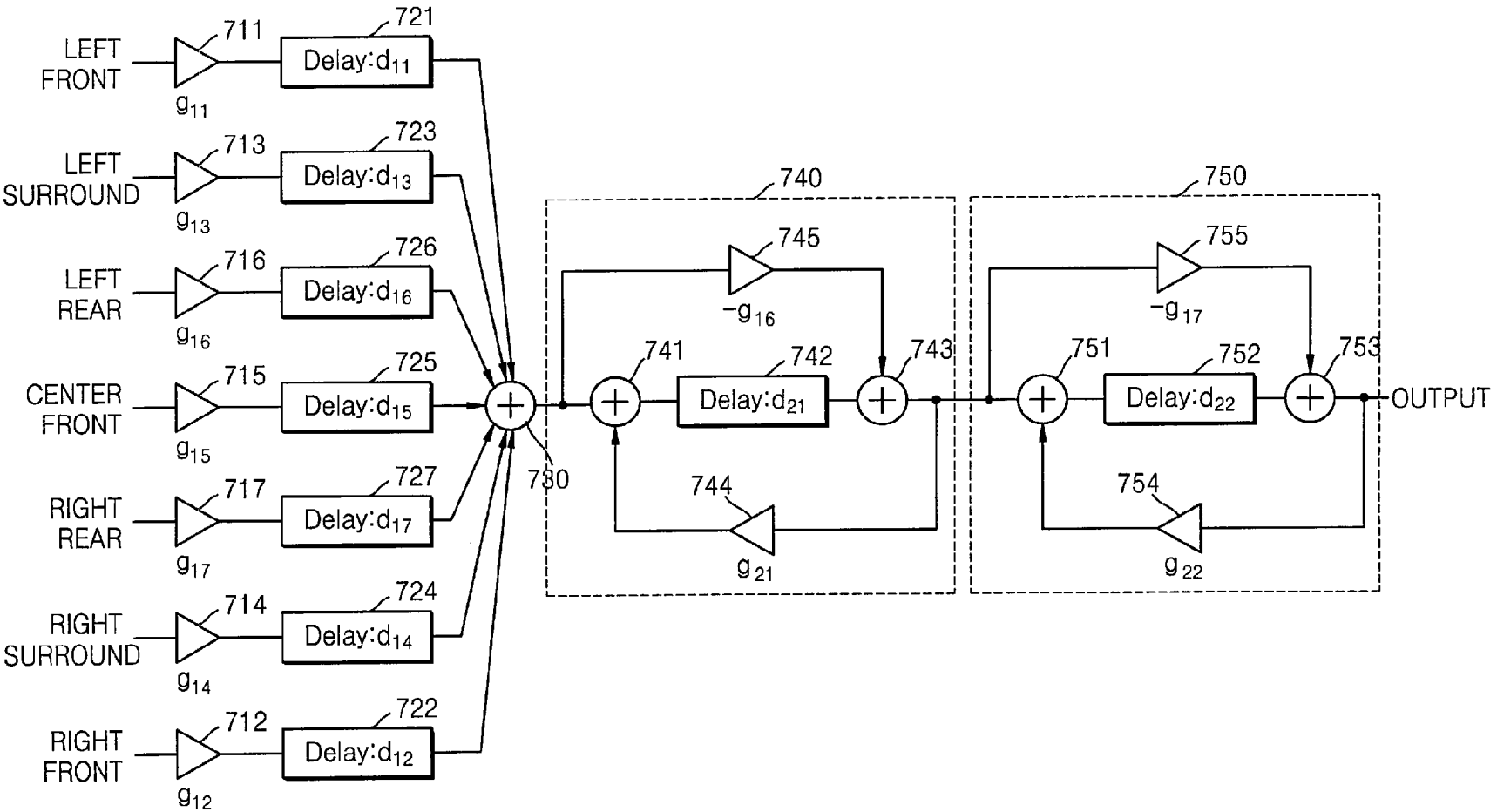
FIG. 11 illustrates the reflected sound generation unit of FIG. 2 for 7.1 channels according to an embodiment of the present general inventive concept.

FIG. 11 illustrates the reflected sound generation unit 340 of FIG. 3 for 7.1 channels according to an embodiment of the present general inventive concept. Referring to FIG. 11, as compared to the 5.1-channel input signal, the 7.1-channel input signal further has a left rear channel and a right rear channel. The left rear channel is generated as a reflected sound passing through a sixth multiplier 716 having a gain value (g16) and a sixth delay filter 726 having a delay value ($d_{16}$), and the right rear channel is generated as a reflected sound passing through a seventh multiplier 717 having a gain value (g17) and a seventh delay filter 727 having a delay value ($d_{17}$).

The signals passing through the sixth and seventh multipliers 716 and 717 and the corresponding sixth and seventh delay units 726 and 727 are added to the other channel signals in the adder 730 and are generated as a plurality of reflected sounds continuously through two all-pass filters 740 and 750 connected in series.

While various embodiments of the present general inventive concept have been particularly illustrated and described with reference to corresponding figures, it will be understood by those of ordinary skill in the art that various changes in form and details may be made therein without departing from the spirit and scope of the present general inventive concept as defined by the following claims.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to various embodiments of the present general inventive concept as described above, a plurality of virtual sound sources are localized such that a stereo effect is provided and reflected sounds are generated such that a spatial effect is provided. Accordingly, a listener can enjoy a stereo sound through 2-channel headphones or speakers with a multi-channel sound reproduced through a medium such as a DVD. Also, if the present general inventive concept is applied to a home theater system, the listener can listen only with 2-channel headphones irrespective of the position of the listener, a stereo sound implemented by a recording medium on which an encoded 5.1-channel signal is recorded. Also, if a plurality of people listen with their respective headphones, an identical stereo sound can be enjoyed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A stereo sound generation method of generating a 2-channel stereo sound from a 5.1-channel sound signal, the method comprising:

generating a first channel stereo signal and a second channel stereo signal, by applying a difference between times taken to arrive at two ears of a listener, respectively, and a difference between sound pressures of the two ears that are different or constant in frequency to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency to each of a third channel signal and a fourth channel signal being input;

generating a first channel signal and a second channel signal from each of a fifth channel signal and a sixth channel signal being input;

generating a plurality of reflected sounds by applying delay values and gain values different from each other to first through fifth channel signals being input, and from the plurality of generated reflected sounds, generating a first channel signal and a second channel signal; and adding the generated first channel signals and adding the generated second channel signals, wherein at least one of the generating steps and the adding step are performed by a controller to generate the 2-channel stereo sound.

2. The method of claim 1, further comprising multiplying the input channel signals by predetermined gain values different from each other, respectively.

3. The method of claim 1, further comprising low-pass filtering the plurality of generated reflected sounds.

4. The method of claim 1, wherein the generating of the plurality of reflected sounds comprises:

multiplying the first through fifth channel signals by gain values different from each other, respectively;

generating reflected sounds by applying delay values different from each other to the multiplied channel signals, respectively;

adding the generated reflected sounds; and continuously generating reflected sounds by passing the added reflected sounds through a plurality of all-pass filters that have delay coefficients different from each other and gain values different from each other, and are connected in series.

5. The method of claim 4, wherein the different delay values are determined with respect to a size of a virtual space.

6. The method of claim 4, wherein the different gain values are determined with respect to a degree of absorbing sound in a virtual space.

7. The method of claim 4, wherein the delay values and gain values of the all-pass filters are determined with respect to a size of a virtual space and a degree of absorbing sound in the virtual space.

8. A stereo sound generation method of generating a 2-channel stereo sound from a 6.1-channel sound signal, the method comprising:

generating a first channel stereo signal and a second channel stereo signal, by applying a difference between times taken to arrive at two ears of a listener, respectively, and a difference between sound pressures of the two ears that are different or constant in frequency to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency to each of a third channel signal and a fourth channel signal being input;

generating a first channel signal and a second channel signal from each of fifth through seventh channel signals being input;

generating a plurality of reflected sounds by applying delay values and gain values different from each other to first through sixth channel signals being input, and from the plurality of generated reflected sounds, generating a first channel signal and a second channel signal; and adding the generated first channel signals and adding the generated second channel signals, wherein at least one of the generating steps and the adding step are performed by a controller to generate the 2-channel stereo sound.

9. The method of claim 8, further comprising low-pass filtering the plurality of generated reflected sounds.

10. The method of claim 8, wherein the generating of the plurality of reflected sounds comprises:

multiplying the first through sixth channel signals by gain values different from each other, respectively;

generating reflected sounds by applying delay values different from each other to the multiplied channel signals, respectively;

adding the generated reflected sounds; and continuously generating reflected sounds by passing the added reflected sounds through a plurality of all-pass filters that have delay coefficients different from each other and gain values different from each other, and are connected in series.

11. A stereo sound generation method of generating a 2-channel stereo sound from a 7.1-channel sound signal, the method comprising:

generating a first channel stereo signal and a second channel stereo signal, by applying a difference between times taken to arrive at two ears of a listener, respectively, and a difference between sound pressures of the two ears that are different or constant in frequency to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency to each of a third channel signal and a fourth channel signal being input;

generating a first channel stereo signal and a second channel stereo signal, by applying the difference between times taken to arrive at the two ears, respectively, and the different between the sound pressures of the two ears that are different or constant in frequency to each of a fifth channel signal and a sixth channel signal being input;

generating a first channel signal and a second channel signal from each of a seventh channel signal and an eighth channel signal being input;

generating a plurality of reflected sounds, by applying delay values and gain values different from each other to first through seventh channel signals being input, and from the plurality of generated reflected sounds, generating a first channel signal and a second channel signal; and adding the generated first channel signals and adding the generated second channel signals, wherein at least one of the generating steps and the adding step are performed by a controller to generate the 2-channel stereo sound.

12. The method of claim 11, further comprising low-pass filtering the plurality of generated reflected sounds.

13. The method of claim 11, wherein the generating of the plurality of reflected sounds comprises:

multiplying the first through seventh channel signals by gain values different from each other, respectively;

generating reflected sounds by applying delay values different from each other, to the multiplied channel signals, respectively;

adding the generated reflected sounds; and continuously generating reflected sounds by passing the added reflected sounds through a plurality of all-pass filters that have delay coefficients different from each other and gain values different from each other, and are connected in series.

14. A non-transitory recording medium containing a method of generating a 2-channel stereo sound from a 5.1-channel sound signal, the method comprising:

generating a first channel stereo signal and a second channel stereo signal, by applying the difference between times taken to arrive at the two ears, respectively, and the difference between the sound pressures of the two ears that are different or constant in frequency, to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input;

generating a first channel signal and a second channel signal from each of a fifth channel signal and a sixth channel signal being input;

generating a plurality of reflected sounds, by applying delay values and gain values different to each other to first through fifth channel signals being input, and from the plurality of generated reflected sounds, generating a first channel signal and a second channel signal; and adding the generated first channel signals and adding the generated second channel signals.

15. A non-transitory recording medium containing a method of generating a 2-channel stereo sound from a 6.1-channel sound signal, the method comprising:

generating a first channel stereo signal and a second channel stereo signal, by applying the difference between times taken to arrive at the two ears, respectively, and the difference between the sound pressures of the two ears that are different or constant in frequency, to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input;

generating a first channel signal and a second channel signal from each of fifth through seventh channel signals being input;

generating a plurality of reflected sounds, by applying delay values and gain values different to each other to first through sixth channel signals being input, and from the plurality of generated reflected sounds, generating a first channel signal and a second channel signal; and adding the generated first channel signals and adding the generated second channel signals.

16. A non-transitory recording medium containing a method of generating a 2-channel stereo sound from a 7.1-channel sound signal, the method comprising:

generating a first channel stereo signal and a second channel stereo signal, by applying the difference between times taken to arrive at the two ears, respectively, and the difference between the sound pressures of the two ears that are different or constant in frequency, to each of a first channel signal and a second channel signal being input;

generating a first channel stereo signal and a second channel stereo signal, by applying the difference between times taken to arrive at the two ears, respectively, and the difference between the sound pressures of the two ears that are different or constant in frequency, to each of a third channel signal and a fourth channel signal being input;

generating a first channel stereo signal and a second channel stereo signal, by applying the difference between times taken to arrive at the two ears, respectively, and the different between the sound pressures of the two ears that are different or constant in frequency, to each of fifth channel signal and a sixth channel signal being input;

generating a first channel signal and a second channel signal from each of a seventh channel signal and an eighth channel signal being input;

generating a plurality of reflected sounds, by applying delay values and gain values different to each other to first through seventh channel signals being input, and from the plurality of generated reflected sounds, generating a first channel signal and a second channel signal; and adding the generated first channel signals and adding the generated second channel signals.

* * * * *